US006189294B1

(12) United States Patent
Baur

(10) Patent No.: US 6,189,294 B1
(45) Date of Patent: Feb. 20, 2001

(54) PACKAGING FOR HIGHLY PERISHABLE, FLEXIBLE SLICES OF FOOD, AND PROCESS FOR INSERTING THE SLICES

(75) Inventor: Wilhelm Baur, Gestratz (DE)

(73) Assignee: Natec Reich Summer GmbH & Co KG, Heimenkirch (DE)

( * ) Notice: Under 35 U.S.C. 154(b), the term of this patent shall be extended for 0 days.

(21) Appl. No.: 09/033,847

(22) Filed: Mar. 3, 1998

(30) Foreign Application Priority Data

Mar. 7, 1997 (DE) ..... 197 09 412

(51) Int. Cl.[7] ..... B65B 5/08; B65B 35/30

(52) U.S. Cl. ..... 53/443; 53/475; 53/244; 53/255; 53/534; 53/542; 53/251

(58) Field of Search ..... 53/534, 542, 251, 53/244, 248, 255, 475, 443, 258, 254

(56) References Cited

U.S. PATENT DOCUMENTS

| | | | | |
|---|---|---|---|---|
| 1,916,227 | | 7/1933 | Lorenzen . | |
| 3,339,714 | | 9/1967 | Thompson | 206/44.11 |
| 3,989,134 | | 11/1976 | Hayashi | 198/424 |
| 4,024,945 | | 5/1977 | Mugishima | 198/424 |
| 4,161,095 | * | 7/1979 | Buday | 53/542 |
| 4,237,677 | | 12/1980 | Klapp | 53/505 |
| 4,241,559 | * | 12/1980 | Klapp | 53/534 |
| 4,524,566 | | 6/1985 | Hauers et al. | 53/534 |
| 4,676,050 | * | 6/1987 | Odenthal | 53/542 |
| 4,768,328 | * | 9/1988 | Mims | 53/542 |
| 4,800,706 | * | 1/1989 | Dorner | 53/542 |
| 4,902,184 | | 2/1990 | Fritz | 414/790.3 |
| 5,460,843 | | 10/1995 | Greene | 426/392 |
| 5,484,613 | | 1/1996 | Fisher, Jr. | 426/124 |
| 5,588,285 | | 12/1996 | Odenthal | 53/534 |

FOREIGN PATENT DOCUMENTS

| | | | | |
|---|---|---|---|---|
| 17561 | | 12/1957 | (DD) . | |
| 19 41 948 U | | 7/1966 | (DE) . | |
| 24 14 386 | | 3/1974 | (DE) . | |
| 28 25 647 C2 | | 12/1979 | (DE) . | |
| 30 50 014 A1 | | 8/1982 | (DE) . | |
| 3050014 | | 8/1982 | (DE) . | |
| 85 18 655 U | | 9/1985 | (DE) . | |
| 87 09 053 U | | 9/1987 | (DE) . | |
| 3801279 | * | 5/1989 | (DE) | 53/542 |
| 86 25 251 U | | 11/1989 | (DE) . | |
| 93 06 0705 U | | 10/1993 | (DE) . | |
| 94 05 628 U1 | | 7/1994 | (DE) . | |
| 94 10 970 U | | 12/1994 | (DE) . | |
| 94 17 420 U | | 1/1995 | (DE) . | |
| 196 04 926 A1 | | 8/1997 | (DE) . | |
| 0 062 249 A1 | | 10/1982 | (EP) . | |
| 2 273 731 | | 1/1976 | (FR) . | |
| 2 286 059 | | 4/1976 | (FR) . | |
| 2654707 | | 11/1989 | (FR) . | |
| 2 654 707 A3 | | 5/1991 | (FR) . | |
| 5-294322 | * | 11/1993 | (JP) | 53/542 |
| 88/07003 | | 9/1988 | (WO) . | |

* cited by examiner

*Primary Examiner*—John Sipos
(74) *Attorney, Agent, or Firm*—Whyte Hirschboeck Dudek SC

(57) ABSTRACT

The invention relates to a package filled with individually foil wrapped, rectangular, in particular square, flexible slices of a highly perishable food, wherein a large number of wrapped slices are disposed, standing substantially upright, as a stack in a container that is open at the top, wherein the stack is enclosed by the four vertical outer walls of the container and the wrapped slices stand on the container bottom, which is preferably ribbed. The entire container can be sealed in a transparent plastic wrapping. A lower front sidewall of the container facilitates removal of individual slices from the container.

20 Claims, 4 Drawing Sheets

PACKAGING FOR HIGHLY PERISHABLE, FLEXIBLE SLICES OF FOOD, AND PROCESS FOR INSERTING THE SLICES

FIELD OF THE INVENTION

The invention relates to a packaging filled with individually foil wrapped rectangular, in particular square, flexible slices of a highly perishable food, such as cheese, sausage, soy, sauce, fruit, vegetables, pressed meat, and the like.

BACKGROUND

It is known for airtight, individually foil wrapped slices of cheese to be placed horizontally on top of one another so that they form a stack of slices that is enclosed by a packaging foil that is printed on the outside in order to give information about the contents, the manufacturer, etc. If the outer packaging foil is torn by the consumer, then it cannot be reused and as a rule, is discarded.

SUMMARY OF THE INVENTION

An object of the invention is to create a packaging that is for individually foil wrapped, flexible slices of food and which can continue to be used to store the slices, after it is opened, and in so doing, permits easy removal of the slices by hand.

This object is achieved according to the invention by virtue of the fact that a large number of wrapped slices are disposed, standing upright, as a stack in a container that is open at the top, wherein the stack is enclosed by the four vertical outer walls of the container and the wrapped slices stand on the container bottom.

The individually packaged slices standing approximately vertically in the container can be easily removed by hand after the container is opened since in their vertical position, they are particularly easy to grasp by hand on the upper edge, and after the removal of an outer wrapping, the container, in particular the container bottom, continues to be used as a storage box for the remaining slices until the last slice is taken out.

A packaging of this kind is not only elegant, but also offers the products to the consumer in an advantageous manner. Furthermore, a packaging of this kind is particularly easy to fill mechanically.

It is particularly advantageous if the wrapped slices and the container bottom form an angle ($\alpha$) of 60 to 85 degrees, particularly of 80 degrees. The bottom of the container should also have a corrugated surface for immobilizing the slices. In this instance, the corrugated surface can be formed by a section made of a stiff material, in particular of cardboard, which on the inner back side of the container is slanted or guided upward at an angle ($\alpha$) of 60 to 85 degrees, in particular of 80 degrees.

It is advantageous if the front side and back side of the container are only slightly greater in width than the width of the slices. Also, the front side of the container should have a lower height than the back side of the container.

It is advantageous if the container is produced as a blank, in particular made of cardboard.

An advantageous process for inserting and storing slices in containers is comprised in that the slices are individually transported downward vertically between two revolving transport belts and slide into the container from above, wherein one slice after another rests against the previous slice and at least one horizontal conveyor belt moves the container along during stacking. In this instance, the containers and preferably the slices can be fixed and moved forward horizontally by means of brush belts and/or brush wheels. Advantageously, after the insertion of the last slice into the container, the conveyor belt or belts are accelerated for a short time until the next empty container has reached the transport belts.

BRIEF FIGURE DESCRIPTION

An exemplary embodiment of the packaging and a packaging apparatus are shown in the drawings and will be described in detail below.

Figure 1:
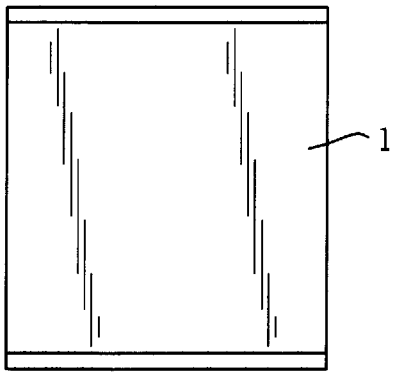
FIG. 1 is a plan view of a slice that is foil wrapped on all sides.
Figure 2:
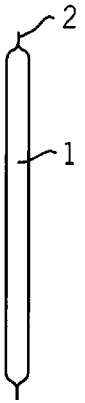
FIG. 2 is an edgewise view of the slice.
Figure 3:
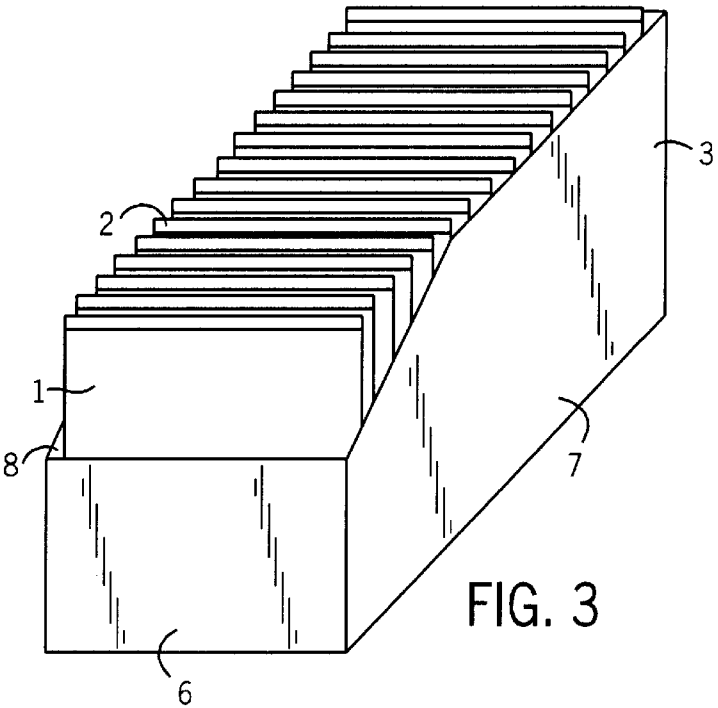
Figure 4:
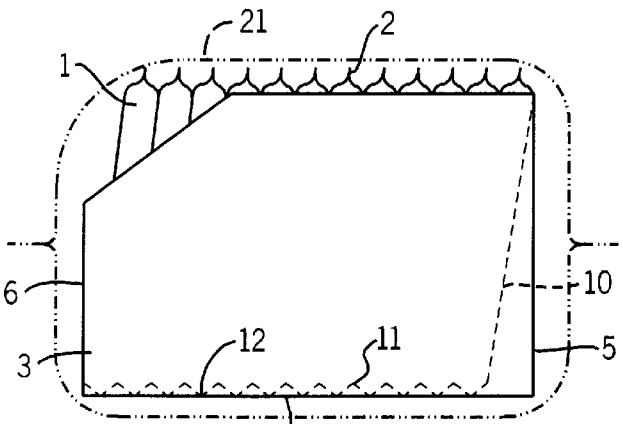
Figure 5:
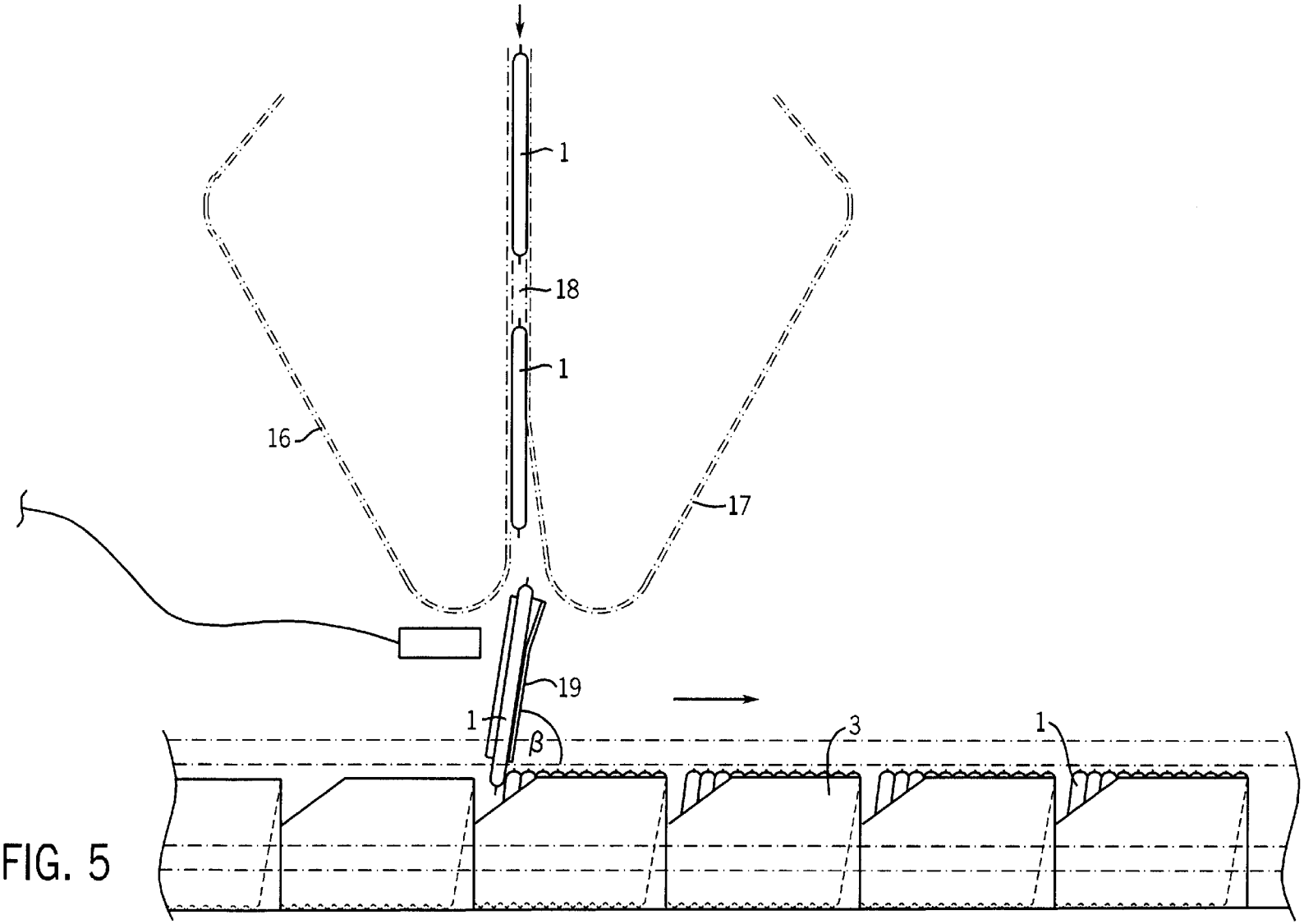
Figure 6:
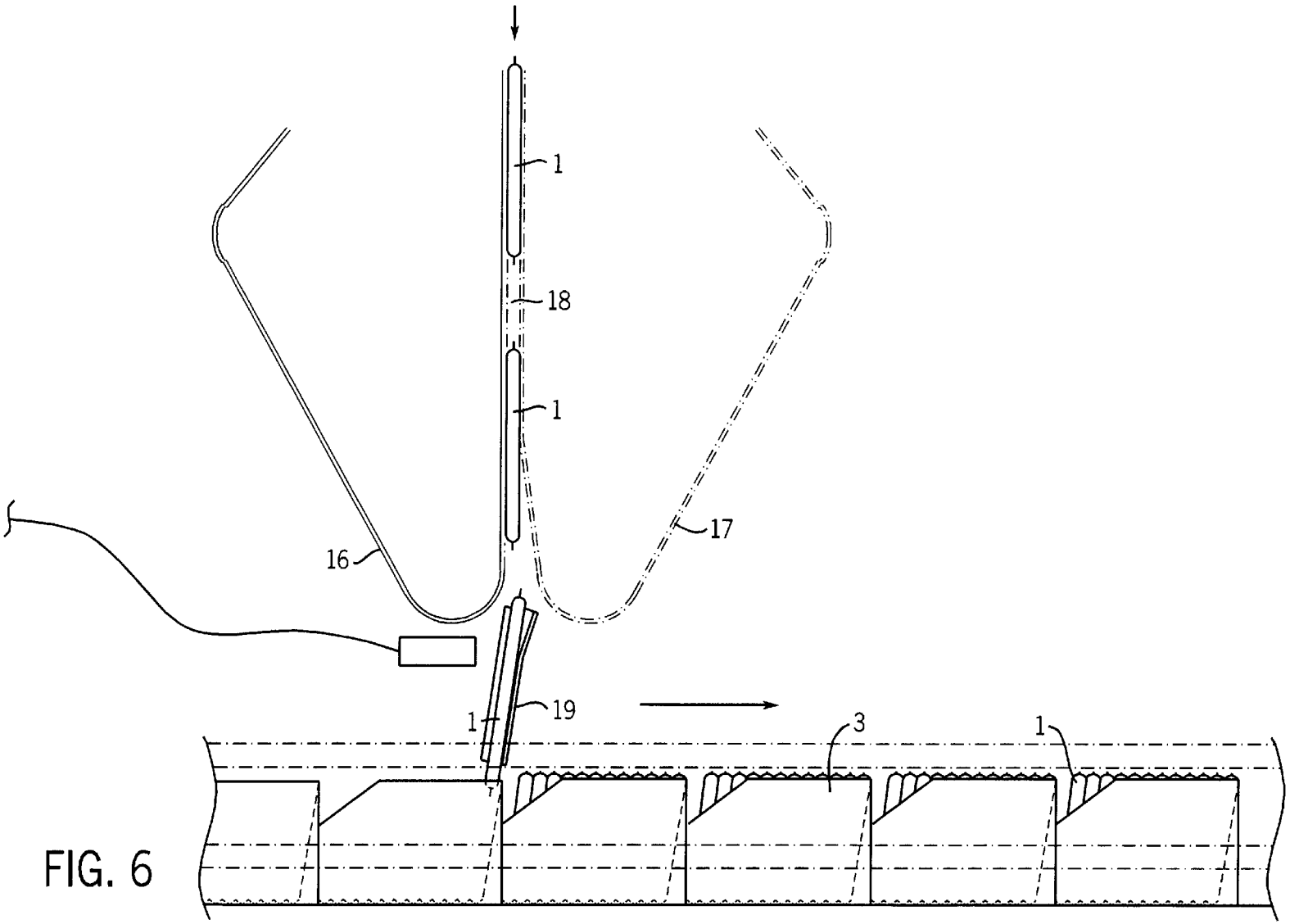
Figure 7:
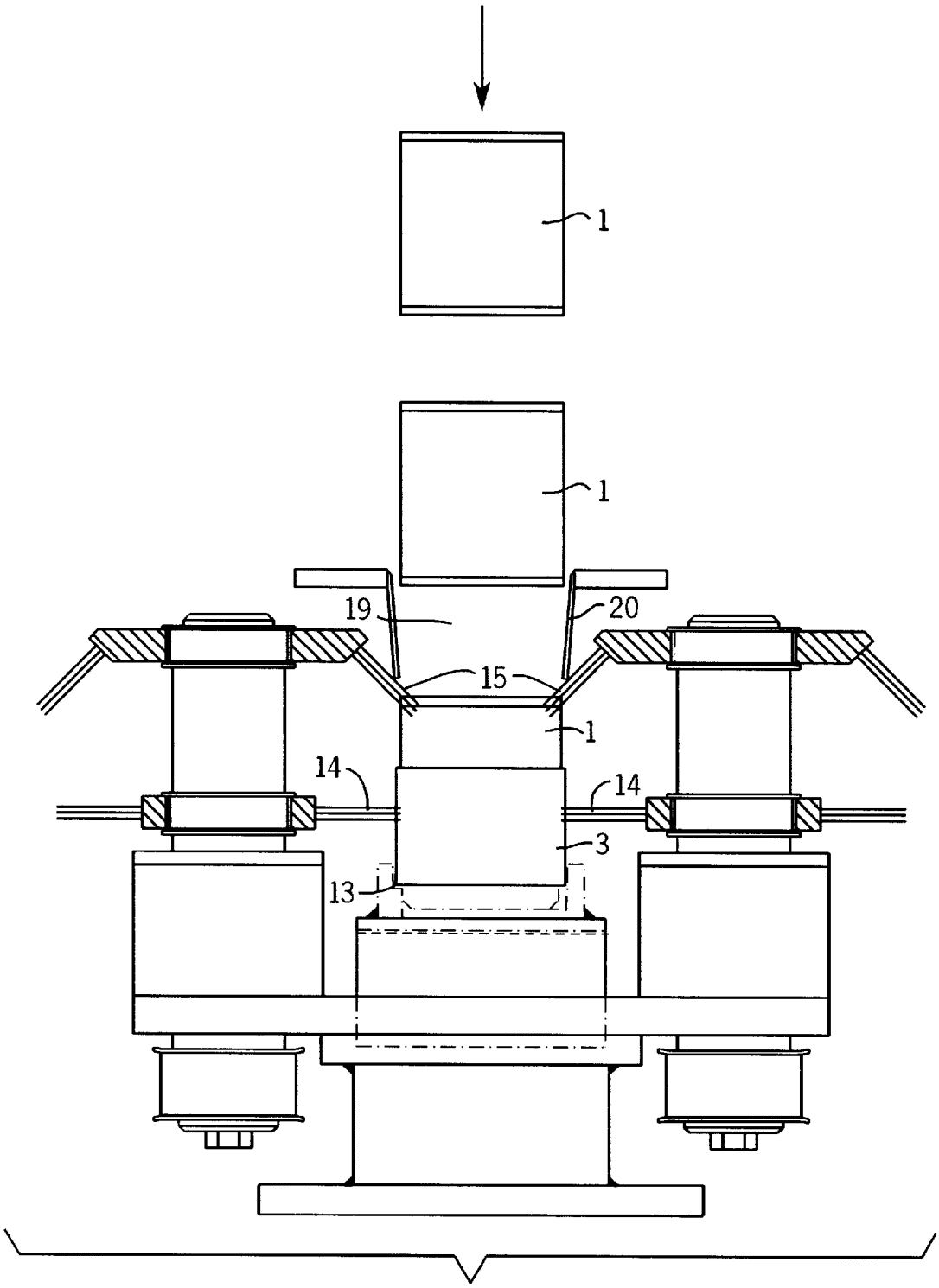

FIG. 3 is a perspective view of a container with stacked slices standing in it, FIG. 4 is a side view of the container according to FIG. 3, with a surrounding wrapping foil, FIG. 5 shows a detail of a packaging apparatus while the last slice is being inserted from above, FIG. 6 shows the packaging apparatus according to FIG. 5, after advancing from the most recently filled container to a new, empty container, and FIG. 7 is a vertical section through the apparatus according to FIGS. 5 and 6.

DETAILED DESCRIPTION

A rectangular, in particular square, flexible and therefore not rigid slice 1 of a few millimeters thick contains a highly perishable food such as cheese, sausage, soy, sauce, fruit, vegetable, pressed meat, or the like and is wrapped on all sides in a plastic foil which is sealed on the edges of the slice and thus forms sealed edges 2 there, so that the slice 1 is disposed in a gas-tight tubular bag whose surfaces rest tightly against the outside of the food.

A number of slices 1 stand vertically, forming a stack in a container (box) 3, in particular made of cardboard, that is open at the top. The container 3 has a vertical front side 4, a vertical back side 5, and two vertical side walls 7, 8 so that the walls 5 to 8 enclose the stack of slices on four sides. In this instance, the front side 4 is lower in height than the back side 5 and in particular than the side walls 7, 8, so that the slices can be removed individually from the front by hand after a container wrapping 21, preferably made of transparent plastic foil, has been removed. This wrapping foil permits the contents of the container to be gas-treated.

The slices 1 do not stand absolutely vertically on the inside of the container 3, but are rather disposed in a slightly inclined arrangement, wherein the slices and the container bottom form an angle $\alpha$ of 60 to 85 degrees, in particular of 80 degrees. So that the selected angle is maintained, on the inside of the rear wall 5, an insert 10, in particular made of cardboard, in the form of an inclined wall, is diagonally set at the same angle $\alpha$, and the back slice 1 rests against it. So that the slices do not slide to the bottom 9, the bottom 9 comprises a corrugated surface 11, in particular made of cardboard, wherein with its underside, each slice 1 rests in a recess 12 defined by two adjacent corrugations or ribs. The corrugated surface 11 can be formed by a section that transitions into the insert 10 and is of one piece with it.

FIGS. 5 to 7 show a detail of an apparatus that fills the container 3 with the individually wrapped slices 1. The apparatus has a lower longitudinal guide 13 in which the containers 3 slide in the transport direction. In this instance, the containers are moved by horizontal conveyor belts 14 provided with brushes and the stacks of slices as well are transported by horizontally revolving brush belts 15. The belts 15, moreover, fix the slices in the package and hold the containers 3 open at the top in order to prevent formation of any disturbed edges. The function and construction of these brush belts 14, 15 are not described in further detail here since their technology is represented extensively in my German patent application P 196 04 926 A1, BAUR et al., published AUG. 14, 1997.

The apparatus has two revolving transport belts 16, 17 disposed above the containers 3, which belts form a vertical transport gap 18 by means of which individual slices 1 are guided downward to the container 3 disposed respectively beneath it. Just above the container, the slices arrive against a guide plate 19 that is slightly inclined at an angle and slide via this plate into the container 3. Two lateral guide plates 20 (FIG. 7) ensure that the slices are also guided toward the sides.

As a result, the slices 1 are individually guided into a vertical or slightly inclined position in the respective container 3, wherein from slice to slice, the container or containers are moved forward by the width of a slice so that one slice after another rests against the preceding one and the stack is formed inside the container. After the insertion of the last slice into the respective container, the advancing movement of the conveyor belts 14, 15 is accelerated for a short period until the next empty container is disposed beneath the transport belts 16, 17 and the guide plate 19.

What is claimed is:

1. A process for inserting and stacking slices into open-topped rectangular containers comprising the steps of:

individually transporting each slice downward vertically between two revolving transport belts against a guide plate disposed below the belts and inclined at an angle relative to the bottom of the container and sliding the slice along the guide plate into a container onto its edge from above, resting each successive slice against the preceding slice, and transporting successive containers along at least one horizontal transport belt.

2. The process according to claim 1, further comprising the step of using brush belts to position and move said slices and said containers.

3. The process according to claim 1, further comprising the step of using brush wheels to position and move said slices and said containers.

4. The process according to claim 1, further comprising the step of briefly accelerating said horizontal transport belt after filling a container with a last slice, until a next empty container is in position for filling.

5. An apparatus for inserting and stacking slices into open-topped containers comprising:

means for individually transporting each slice downward toward one of the containers forming a vertical transport gap;

means for sliding each slice into one of the containers from above disposed under and on one side of the transport gap at an inclination relative to the bottom of the container along which sliding means said slice slides into the container onto its edge while resting against the other slices in the container;

means for transporting successive containers along at least one horizontal transport belt.

6. The apparatus of claim 5 further comprising a guide plate located between the open-topped containers and the pair of transport belts, the guide plate disposed at an angle relative to a vertical orientation.

7. The apparatus according to claim 6 further comprising a pair of lateral guide plates located between the open-topped containers and the pair of transport belts.

8. The apparatus according to claim 5 further comprising a horizontal conveyor located below the pair of transport belts for transporting the open-topped containers in a horizontal direction.

9. The apparatus according to claim 8 wherein the horizontal conveyor is provided with brushes to position and move the slices and containers.

10. The apparatus according to claim 9 further comprising horizontally revolving brush belts adapted for transporting the stacks of slices formed by the apparatus.

11. An apparatus for inserting and stacking slices into open-topped containers comprising:

a pair of transport belts disposed above the open-topped containers and adjacent to each other to form a vertical transport gap for individually transporting slices downward toward the open-topped containers;

a guide plate located between the open-topped containers and the pair of transport belts, the guide plate comprising a plate on one side of the transport gap inclined at an angle relative to the bottom of the container along which plate said slice slides into the container onto its edge while resting against the other slices in the container.

12. The apparatus according to claim 11 wherein the angle is in a range of 60 to 85 degrees.

13. The apparatus of claim 11 wherein the angle is substantially 80 degrees.

14. The process according to claim 1 wherein the resting step includes resting each successive slice at an angle relative to a vertical orientation.

15. The process of claim 14 wherein the angle is in a range of 60 to 85 degrees.

16. The process of claim 14 wherein the angle is substantially 80 degrees.

17. The process of claim 1 wherein the sliding step includes sliding the slice into a corrugated surface within the container.

18. The apparatus according to claim 6 wherein the guide plate is disposed at an angle relative to a vertical orientation.

19. The apparatus according to claim 18 wherein the angle is in a range of 60 to 85 degrees.

20. The apparatus according to claim 5 wherein the individually transporting means comprise a pair of transport belts disposed above the open-topped containers and adjacent to each other to form a vertical transport gap for transporting slices downward toward the open-topped containers.

* * * * *